United States Patent [19]

Laing

[11] Patent Number: 4,494,863

[45] Date of Patent: Jan. 22, 1985

[54] CLEANING APPARATUS FOR A CHARGE RETENTIVE SURFACE

[75] Inventor: John R. Laing, Rochester, N.Y.

[73] Assignee: Xerox Corporation, Stamford, Conn.

[21] Appl. No.: 517,151

[22] Filed: Jul. 25, 1983

[51] Int. Cl.[3] ..... G03G 21/00

[52] U.S. Cl. ..... 355/15; 15/256.51

[58] Field of Search ..... 355/15; 15/256.51, 256.52

[56] References Cited

U.S. PATENT DOCUMENTS

| | | | |
|---|---|---|---|
| 3,572,923 | 3/1971 | Fisher et al. | 355/15 |
| 3,722,018 | 3/1973 | Fisher | 15/1.5 |
| 4,054,381 | 10/1977 | Bernhard | 355/15 |
| 4,116,555 | 9/1978 | Young et al. | 355/15 |
| 4,265,990 | 5/1981 | Stolka et al. | 430/59 |

FOREIGN PATENT DOCUMENTS

| | | | |
|---|---|---|---|
| 54-30832 | 3/1979 | Japan | 355/15 |
| 56-137378 | 10/1981 | Japan | 355/15 |

*Primary Examiner*—A. T. Grimley
*Assistant Examiner*—David Warren

[57] ABSTRACT

Toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and Kaolin from the brush. The rolls are electrically biased so that one of them attracts toner from the brush while the other one attracts debris. Thus, the toner can be reused without degradation of copy quality while the debris can be discarded.

31 Claims, 2 Drawing Figures

CLEANING APPARATUS FOR A CHARGE RETENTIVE SURFACE

Figure 1:
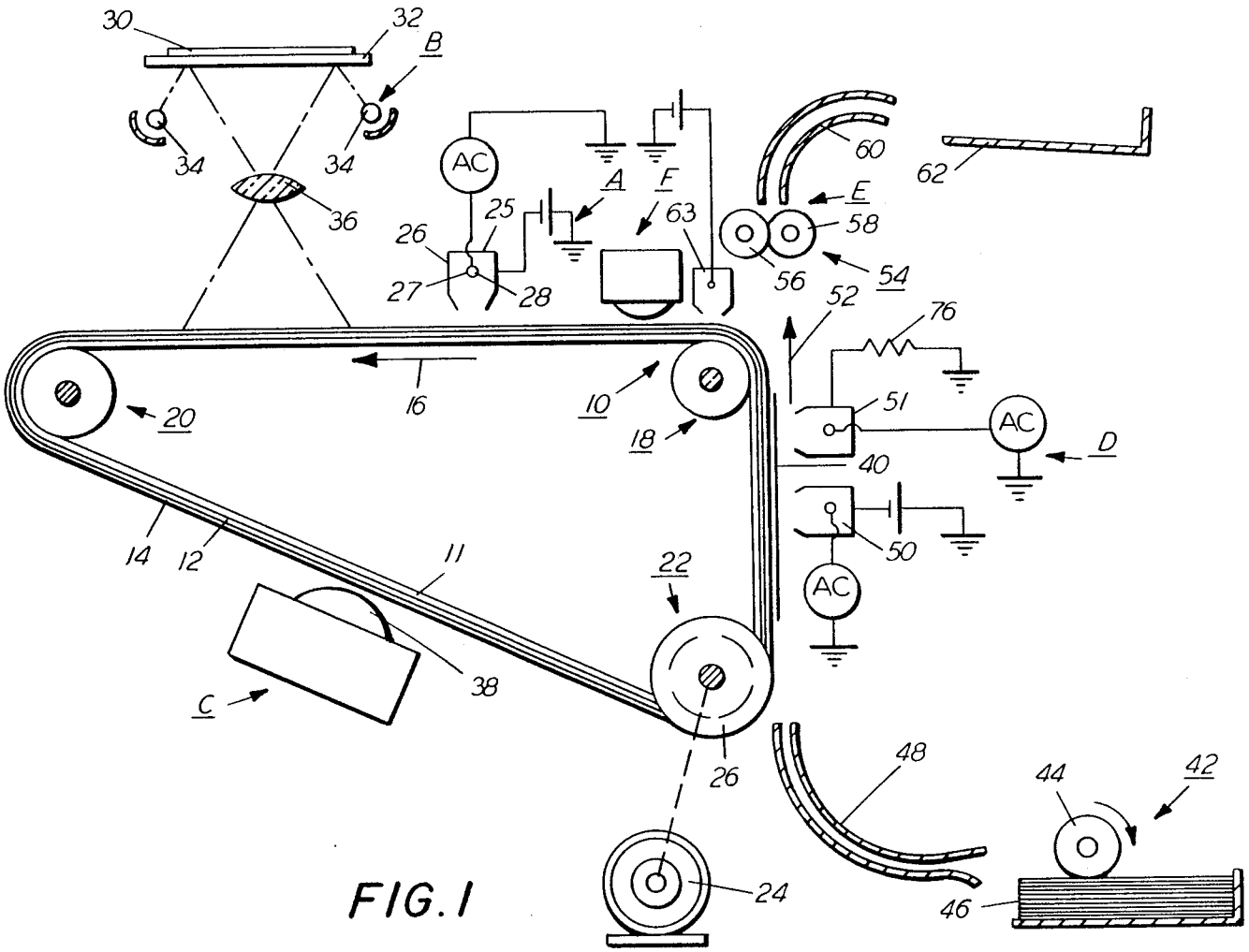

This invention relates to printing apparatus and more particularly to cleaning apparatus for removing residual toner and debris such as paper fibers and Kaolin from a charge retentive surface forming a part of the printing apparatus with subsequent electrostatic separation of the toner from the debris.

In printing arts of the type contemplated, a charge retentive surface such as a photoconductor which comprises a photoconductive insulating material adhered to a conductive backing is charged uniformly. Then the photoreceptor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer, toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner remaining on the surface be cleaned thoroughly therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon also rely on electrostatic fields established by electrically biasing one or more members of the cleaner system.

It has been found that establishing an electrostatic field between the charge retentive surface and the cleaning member such as a fiber brush or a magnetic brush enhances toner attraction to the cleaning brush surface. Such arrangements are disclosed in U.S. Pat. Nos. 3,572,923 and 3,722,018 granted to Fisher et al. on Mar. 22, 1973 and Fisher on Mar. 30, 1971, respectively. Likewise, when an electrostatic field is established between the brush and a brush detoning member, removal of toner from the brush is improved. The creation of the electrostatic field between the brush and photoreceptor is accomplished by applying a d.c. voltage to the brush. When the fibers or granules forming the brush are electrically conductive and a bias is applied thereto cleaning is observed to be more efficient than if the fibers or granules are non-conductive or insulative.

U.S. patent application Ser. No. 130,805 filed Mar. 17, 1980 in the name of Seanor et al. and assigned to the same assignee as this invention discloses a magnetic brush and insulative detoning roll both of which have electrical biases applied thereto for establishing the desired electrostatic fields between the brush and the photoreceptor and between the brush and the detoning roll. This application was published in Brazil on Sept. 22, 1981.

The field established between the conductive brush and the insulative photoreceptor is such that the toner on the photoreceptor is attracted to the brush. Thus, if the toner on the photoreceptor is positively charged then the aforementioned field would be negative. In order to attract the toner from the brush onto the detoning roll, the detoning roll is electrically biased to a greater negative potential than the brush.

A device that is structurally similar to the Seanor device is disclosed in U.S. Pat. No. 4,116,555. However, that device has a biased brush for removing background toner from a photoreceptor and has two rolls for removing the background particles from the background removal brush and returning same to the developer sump. To that end the U.S. Pat. No. 4,116,555 device utilizes two detoning rolls which are biased to opposite polarities. In that way, both positive and negative toner in the background areas can be removed from the photoreceptor.

Figure 2:
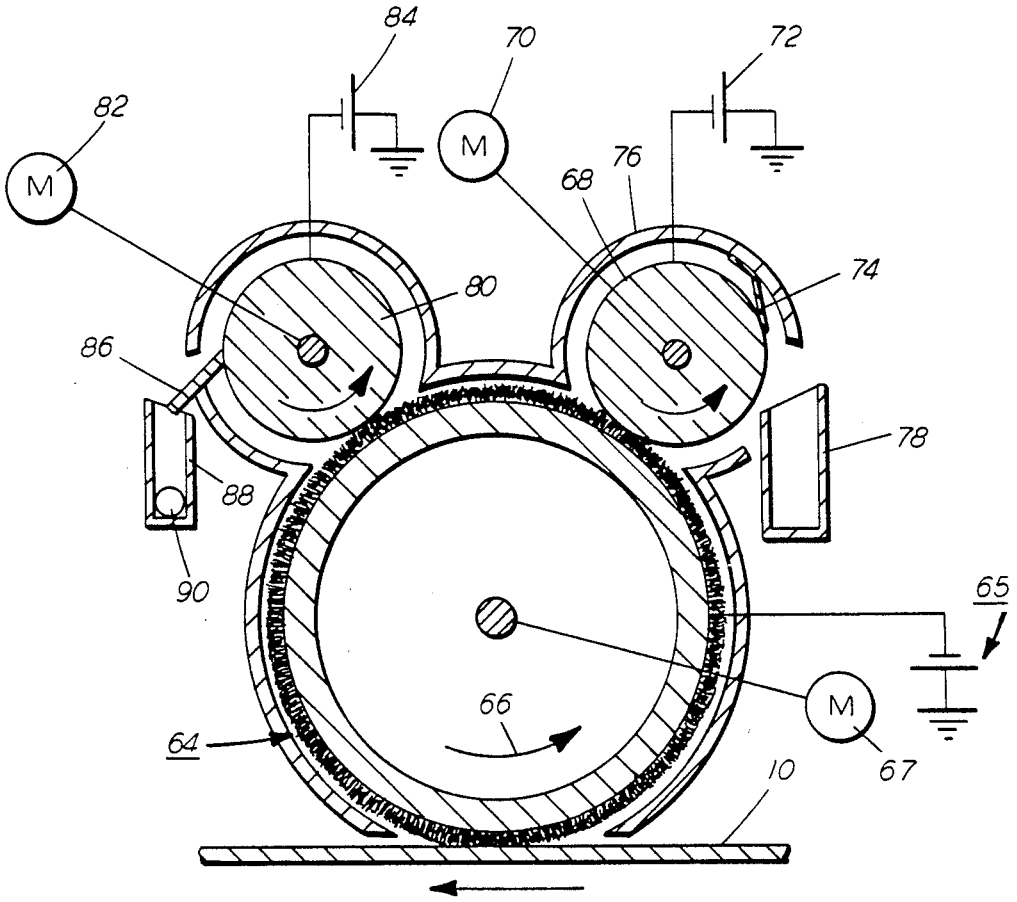

Other aspects of the present invention will become apparent as the following description proceeds with reference to the drawings wherein:

FIG. 1 is a schematic elevational view depicting an electrophotographic printing machine incorporating the present invention; and FIG. 2 is a schematic illustration of a cleaner incorporated in the machine of FIG. 1.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges layer 14 of belt 10 to a relatively high, substantially uniform negative potential. A suitable corona generating device for negatively charging the photoreceptor belt 10 comprises a conductive shield 26 and corona wire 27 the latter of which is coated with an electrically insulating layer 28 having a thickness which precludes a net d.c. corona current when an a.c. voltage is applied to the corona wire. Application of a suitable d.c. bias on the conductive shield 26 will result in a suitable charge being applied to the photoreceptor belt as it is advanced through exposure station B. At exposure station B, an original document 30 is positioned face down upon a transparent platen 32. The light rays reflected from original document 30 form images which are transmitted through lens 36. The light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

A preclean dicorotron 63 is provided for exposing the residual toner and contaminents to positive charges to thereby narrow the charge distribution thereon so that a negatively biased cleaning roller, to be discussed hereinafter, will be more effective in removing them.

At a cleaning station F, residual toner and contaminants or debris such as paper fibers and Kaolin are removed from the phtoreceptor surface by means of a captive magnetic brush 64 which is negatively biased by means of a power source 65 and which is rotated in the direction of the arrow 66 via motor 67. In a xerographic system of the type disclosed herein, the brush 64 will remove both toner and debris from the photoreceptor, the former having a positive and the latter having a negative charge. The negatively charged contaminants are removed along with the positively charged toner particles to which they may be adhered. In accordance with the invention, the toner and debris removed is first contacted by a detoning roll 68 which is supported for rotation in a direction counter to that of the brush 64 by means of a motor 70. An electrical bias is supplied to the roll 68 from a source of d.c. power 72. The polarity of the bias applied to the roll 72 is the same but it is less negative than that applied to the brush so that an electrostatic field is created between the brush 64 and the roll 68 which causes the negatively charged debris to be attracted to the roll 68. The debris attracted to the roll 68 is removed therefrom by a scraper 74 attached to a cleaner housing section 76. The debris is delivered to a container 78 where it is temporarily stored prior to disposal. In an operative embodiment of the invention, the bias applied to the brush was a −170 volts and the bias applied to roll 68 was −70 volts. At these biases, satisfactory removal of debris was obtained.

After removal of the debris, the materials removed from the photoreceptor are subsequently contacted by another detoning roll 80 which is also rotated in a direction opposite to that of the brush 64, such rotation being effected by means of a motor 82. The roll 80 like the roll 68 is also electrically biased but biasing is such that the roll 80 is more negative than the brush 64. Thus, a negative electrostatic field is established between the roll 80 and the brush which results in the positively charged residual toner being attracted from the brush 64 to the roll 80. Biasing of the roll 80 is provided by a d.c. power source 84. A scraper is provided to remove the toner from the roll 80, the toner so removed falls into a receiver 88 wherein an auger 90 is contained, the auger being adapted to transport the removed toner to the developer housing C.

As can be appreciated from the foregoing, a cleaner has been disclosed that is effective in separating residual toner and debris removed from a charge-retentive surface so that toner which is relatively free of paper fibers and fillers such as Kaolin can be reused without adversely impacting the copy quality.

I claim:

1. Printing apparatus including:

a charge-retentive surface;

latent image forming means;

means for forming a toner image;

development means;

transfer means;

means for removing residual toner and debris from said charge-retentive surface;

said image forming, development, transfer and toner removing means being positioned adjacent said charge-retentive surface so that sections of said charge-retentive surface can be moved therepast in that order;

said residual toner and debris removing means comprising:

a brush supported for rotation and contact with said surface for removing residual toner and debris therefrom;

a first detoning member supported for contact with said brush;

a second detoning member supported for contact with said brush; and means for electrically biasing said brush and said first and second detoning members to thereby establish an electrostatic field between said brush and each of said detoning members; said electrical biasing means being such as to cause one of said detoning members to attract toner from said brush and the other of said detoning members to attract debris therefrom.

2. Apparatus according to claim 1 including means for removing said toner from said one of said detoning members and depositing it in a first location and further including means for removing said debris from said other of said detoning members and depositing it in a separate location from said first location.

3. Apparatus according to claim 2 wherein said electrical biasing means is designed to establish different voltage differences between said one of said detoning members and said brush and between said other of said detoning members and said brush.

4. Apparatus according to claim 3 wherein the voltage difference between said brush and said one of said detoning members is approximately 100 volts and the voltage difference between said brush and said other detoning member is approximately 150 volts.

5. Apparatus according to claim 4 wherein said brush is a magnetic brush.

6. Apparatus according to claim 4 wherein said brush comprises electrically conductive fibers.

7. Apparatus according to claim 2 wherein said detoning members comprise rolls supported for rotation.

8. Apparatus according to claim 7 wherein said rolls are disposed relative to said brush such that toner and debris removed from said charge-retentive surface is first contacted by the detoning roll which attracts debris.

9. Apparatus according to claim 8 wherein both of said detoning rolls rotate in the same direction as said brush.

10. Apparatus according to claim 9 wherein said electrical biasing means is designed to establish different voltage differences between said brush and said detoning rolls.

11. Apparatus according to claim 10 wherein said voltage differences are relatively low.

12. Apparatus according to claim 11 wherein the voltage difference between the detoning roll which attracts debris and said brush is approximately 100 volts and the voltage difference between the detoning roll which attracts toner and said brush is approximately 150 volts.

13. Apparatus according to claim 12 wherein said brush comprises magnetic bristles.

14. Apparatus according to claim 13 wherein said brush comprises electrically conductive bristles.

15. Apparatus according to claim 14 wherein said detoning rolls have an electrically insulative coating on the surface thereof.

16. Apparatus according to claim 6 wherein said detoning members have electrically insulative surfaces.

17. Printing apparatus including:

a charge-retentive surface;

latent image forming means;

means for forming a toner image;

development means;

transfer means;

means for removing residual toner and debris from said surface;

said residual toner and debris removing means comprising:

a brush supported for rotation and contact with said surface for removing residual toner and debris therefrom;

a first detoning member supported for contact with said brush;

a second detoning member supported for contact with said brush;

means for electrically biasing said brush and said first and second detoning members to thereby establish an electrostatic field between said brush and each of said detoning members; said electrical biasing means being such as to cause one of said detoning members to attract toner from said brush and the other of said detoning members to attract debris therefrom; and means for removing said toner from said one of said detoning members and depositing it in a first location and further including means for removing said debris from said other of said detoning members and depositing it in a separate location from said first location.

18. Apparatus according to claim 17 wherein said electrical biasing means is designed to establish different voltage differences between said one of said detoning members and said brush and between said other of said detoning members and said brush.

19. Apparatus according to claim 18 wherein the voltage difference between said brush and said one of said detoning members is approximately 100 volts and the voltage difference between said brush and said other detoning member is approximately 150 volts.

20. Apparatus according to claim 1 wherein said brush is a magnetic brush.

21. Apparatus according to claim 19 wherein said brush comprises electrically conductive fibers.

22. Apparatus according to claim 17 wherein said detoning members comprise rolls supported for rotation.

23. Apparatus according to claim 22 wherein said rolls are disposed relative to said brush such that toner and debris removed from said charge-retentive surface is first contacted by the detoning roll which attracts debris.

24. Apparatus according to claim 23 wherein both of said detoning rolls rotate in the same direction as said brush.

25. Apparatus according to claim 24 wherein said electrical biasing means is designed to establish different voltage differences between said brush and said detoning rolls.

26. Apparatus according to claim 25 wherein said voltage differences are relatively low.

27. Apparatus according to claim 26 wherein the voltage difference between said detoning roll which attracts debris and said brush is approximately 100 volts and the voltage difference between the detoning roll which attracts toner and said brush is approximately 150 volts.

28. Apparatus according to claim 27 wherein said brush comprises magnetic bristles.

29. Apparatus according to claim 28 wherein said brush comprises electrically conductive bristles.

30. Apparatus according to claim 29 wherein said detoning rolls have an electrically insulative coating on the surface thereof.

31. Apparatus according to claim 21 wherein said detoning members have electrically insulative surfaces.

* * * * *